US009415971B2

(12) United States Patent
Duchanois et al.

(10) Patent No.: US 9,415,971 B2
(45) Date of Patent: Aug. 16, 2016

(54) ADJUSTABLE COIL PROTECTOR

(71) Applicant: Signode Industrial Group LLC, Glenview, IL (US)

(72) Inventors: Dominique Duchanois, Luxeuil les Bains (FR); John M. Kruelle, Glendale, AZ (US)

(73) Assignee: Signode Industrial Group LLC, Glenview, IL (US)

( * ) Notice: Subject to any disclaimer, the term of this patent is extended or adjusted under 35 U.S.C. 154(b) by 0 days.

(21) Appl. No.: 14/448,665

(22) Filed: Jul. 31, 2014

(65) Prior Publication Data

US 2015/0108022 A1 Apr. 23, 2015

Related U.S. Application Data

(60) Provisional application No. 61/892,119, filed on Oct. 17, 2013.

(51) Int. Cl.

*B65H 75/18* (2006.01)
*B65H 75/24* (2006.01)
*B65D 85/04* (2006.01)

(52) U.S. Cl.

CPC ..... *B65H 75/185* (2013.01); *B65D 85/04* (2013.01); *B65H 75/242* (2013.01)

(58) Field of Classification Search

CPC ..... B65D 85/04; B65D 85/06; B65D 85/02; B65H 75/12; B65H 75/185; B65H 75/187; B65H 75/22; B65H 75/24; B65H 75/242

USPC ..... 206/413–416, 303, 493, 340; 40/663, 40/665, 668; 224/175

See application file for complete search history.

(56) References Cited

U.S. PATENT DOCUMENTS 291,406 A * 1/1884 Sanger ..... B65D 85/671 206/414
542,728 A 7/1895 Duval (Continued)

FOREIGN PATENT DOCUMENTS

CA 608 619 11/1960
GB 243 453 11/1925

OTHER PUBLICATIONS

Coiled Metal Handling , available at http://www.polyflexpro.com/coiled-metal-handling, printed Sep. 12, 2013 (3 pages).

(Continued)

*Primary Examiner* — Anthony Stashick
*Assistant Examiner* — Robert Poon
(74) *Attorney, Agent, or Firm* — Neal, Gerber & Eisenberg LLP

(57) ABSTRACT

Various embodiments of the present disclosure provide a reusable adjustable coil protector for a plurality of differently sized coils. The adjustable coil protector has an unassembled generally linear resting configuration and plurality of different assembled generally cylindrical configurations. The adjustable coil protector is formed and maintained in the generally linear unassembled configuration for storage and transport before and after use. The adjustable coil protector is bent and wrapped around itself, positioned, and securely locked in a user selected one of the plurality of different assembled generally cylindrical configurations prior to mounting the adjustable coil protector on a coil. The adjustable coil protector is configured to reduce inventory, shipping, and warehousing space needed for the adjustable coil protector because the adjustable coil protector can be used on a plurality of differently sized coils or the same size coils with different sized central openings.

18 Claims, 7 Drawing Sheets

(56) References Cited

U.S. PATENT DOCUMENTS

| | | | | | |
|---|---|---|---|---|---|
| 1,772,850 | A | | 8/1930 | Wheldon | |
| 1,809,267 | A | | 6/1931 | Cushing | |
| 1,989,182 | A | | 1/1935 | Valerie | |
| 1,989,183 | A | * | 1/1935 | Blake | B65D 85/671 206/414 |
| 2,037,609 | A | | 4/1936 | Ochoa | |
| 2,155,312 | A | | 4/1939 | Houtzaager | |
| 2,435,093 | A | | 1/1948 | Mitschrich | |
| 2,460,434 | A | | 2/1949 | Salem | |
| 2,927,710 | A | | 3/1960 | Raber | |
| 2,943,732 | A | * | 7/1960 | Kovaleski | B65D 85/04 206/303 |
| 3,003,296 | A | | 10/1961 | Feldkamp et al. | |
| 3,049,260 | A | | 8/1962 | Stone | |
| 3,203,453 | A | * | 8/1965 | McConnell | B21C 47/24 140/92.1 |
| 3,329,262 | A | | 7/1967 | Hollinshead et al. | |
| 3,332,601 | A | | 7/1967 | Frank, Jr. | |
| 3,378,987 | A | | 4/1968 | Lems | |
| 3,453,695 | A | | 7/1969 | Owen | |
| 3,670,877 | A | | 6/1972 | Reed | |
| 3,875,617 | A | | 4/1975 | Cline et al. | |
| 3,878,940 | A | | 4/1975 | Wittebort et al. | |
| 4,004,396 | A | | 1/1977 | Nijs | |
| 4,015,711 | A | | 4/1977 | Mason | |
| 4,063,702 | A | | 12/1977 | Wilde | |
| RE30,168 | E | | 12/1979 | Mason | |
| 4,202,449 | A | | 5/1980 | Bendt | |
| 4,204,479 | A | | 5/1980 | Rosa | |
| 4,513,864 | A | | 4/1985 | Liebel | |
| 4,516,892 | A | | 5/1985 | Curro | |
| 4,677,728 | A | | 7/1987 | Straus | |
| 4,742,916 | A | | 5/1988 | Galea | |
| 4,865,201 | A | | 9/1989 | Liebel | |
| 4,874,095 | A | | 10/1989 | Warych | |
| 4,877,673 | A | | 10/1989 | Eckel et al. | |
| 4,929,226 | A | | 5/1990 | Focke et al. | |
| 4,990,040 | A | | 2/1991 | Nulle et al. | |
| 4,995,512 | A | | 2/1991 | Liebel | |
| 5,114,010 | A | | 5/1992 | Smith | |
| 5,170,938 | A | | 12/1992 | Dewing | |
| 5,236,087 | A | | 8/1993 | Morgan | |
| 5,377,831 | A | | 1/1995 | Crooks | |
| 5,385,236 | A | | 1/1995 | Cowan | |
| 5,413,220 | A | | 5/1995 | Sirianni | |
| 5,480,106 | A | * | 1/1996 | Voissem | B65H 75/12 242/571 |
| 5,660,277 | A | | 8/1997 | Bostic | |
| 5,839,250 | A | | 11/1998 | Hibler | |
| 5,861,204 | A | | 1/1999 | O'Sullivan | |
| 5,899,046 | A | | 5/1999 | Hughes | |
| 6,092,321 | A | * | 7/2000 | Cheng | G09F 3/005 40/633 |
| 6,183,840 | B1 | | 2/2001 | Arrowsmith | |
| 6,458,448 | B1 | | 10/2002 | Hunt | |
| 6,783,833 | B2 | | 8/2004 | Bordner et al. | |
| 6,796,333 | B2 | | 9/2004 | Birkel et al. | |
| 6,868,969 | B2 | | 3/2005 | Gosis et al. | |
| 8,038,010 | B1 | | 10/2011 | Rometty et al. | |
| 8,166,685 | B2 | * | 5/2012 | Mouille | A01K 11/00 119/863 |
| 2013/0270138 | A1 | * | 10/2013 | Weber | B65H 75/185 206/414 |

OTHER PUBLICATIONS

Pulse Plastics | Manufacturer of Edge Protection Packaging for Coils of Sheet Steel available at http://www.pulseplastics.co.uk/our-products.aspx, printed Jul. 31, 2014 (4 pages).

* cited by examiner

ADJUSTABLE COIL PROTECTOR

PRIORITY CLAIM

This application claims priority to and the benefit of U.S. Provisional Patent Application No. 61/892,119, filed on Oct. 17, 2013, the entire contents of which are incorporated herein by reference.

BACKGROUND

Various types of materials are made and rolled into relatively large cylindrical coils for shipment to purchasers who use the materials to make products. While some materials (such as wires) are rolled on spools, many materials are not rolled on spools and, in such cases, the coils typically have a central cylindrical opening that is defined by the material itself. Example materials include papers and metals (such as steel, aluminum, and tin).

More specifically, for example, the steel industry makes sheet steel and rolls the sheet steel into coils (with central cylindrical openings) for use by various manufacturers (such as automobile and automobile part manufacturers). Steel sheets are typically rolled on a mandrel during the final phase of manufacture. These mandrels typically have a diameter of 20 or 24 inches. These steel coils are extremely heavy and typically weigh between 30,000 and 80,000 pounds. Two, three, four, or more steel straps are typically placed through the central opening and wrapped around the outside of the steel coil to prevent the steel coil from uncoiling or unrolling during storage and transport of the steel coil. Steel coils are also sometimes wrapped in paper or plastic to protect the steel coils during storage and transport of the steel coils.

Cranes (such as overhead cranes) are often employed to transport or maneuver these large coils in the manufacturing facilities and in the production or use facilities (following their delivery to customers). These cranes typically have a generally L-shaped or C-shaped hook or engaging implement (such as a tong or tongue) that is positioned inside the central cylindrical opening of the coil and that engages the upper portion of the inner surface that defines the central opening of the coil. These hooks are commonly used to engage, lift, and move the coils in the coil manufacturing facilities and in the coil use facilities, particularly when the coils are loaded into and unloaded from transport vehicles, such as trucks and freight railroad cars. The hook is typically inserted into one end of the central opening of the coil and is then raised to engage the upper portion of the inner surface that defines the central cylindrical opening of the coil to lift the coil and to move the coil to the desired location. The hook can damage the material of the coil, particularly by bending the edges of the material of the coil that define or that are located adjacent to the central opening of the coil. For example, when the hook is placed through the central opening of the coil and raised upwardly into engagement with the upper portion of the inner surface that defines the central opening, the hook may not simultaneously, evenly, or with equal pressure engage that upper surface at both opposite edges that define the central opening. Instead, the hook may first engage one edge and then the other. When this happens, the pressure of the hook on the material can cause bending or other damage to the material of the coil that defines or that is adjacent to the central opening. This bent material is typically not usable. In steel coils, it is not uncommon for the material user to have to scrap several feet of the sheet steel due to such damage.

In addition to the damage that can be caused by the hook during loading and unloading of the coils, transporters often throw a chain through the central opening of the coil to secure the coil on the transport vehicle (such as a truck or a freight railroad car). This chain can also damage the inner surfaces that define the central opening of the coil or the surfaces that are adjacent to the central opening of the coil.

Plastic coil protectors have been employed to solve these problems. For example, U.S. Pat. No. 4,513,864 and U.S. Pat. No. 6,783,833 disclose plastic coil protectors that are configured to protect the material that defines the central opening of the coil and the material of the coil adjacent to the central opening. These coil protectors are typically strapped in place as shown in FIG. 1 of U.S. Pat. No. 4,513,864. In some instances, wrapping machines are employed to wrap both the coil and the coil protectors with a paper or shrink wrap covering.

While these known coil protectors generally protect the coils, they create additional problems.

For example, these known coil protectors are made in separate plastic manufacturing facilities and then shipped to coil manufacturing facilities. These known coil protectors are relatively large and bulky; have fixed circumferences and diameters; and, when they are stacked for storage and transport, they take up a considerable amount of space. Substantial space must be provided at the plastic manufacturing facilities, in the transport vehicles, and at the coil manufacturing facilities for these known coil protectors. After these known coil protectors are used and are no longer needed at the coil material use facilities, they are sometimes stored and shipped back to the coil manufacturing facilities. This storage and transport cost is also very high because these known coil protectors are relatively large and bulky. In some instances, these known plastic coil protectors are recycled. In other instances, partly due to their size, these known plastic coil protectors are placed in the garbage and not recycled. In such instances, these known coil protectors take up substantial space in landfills.

Another problem with these known coil protectors is that they do not account for variations that occur in the sizes of the central openings of the coils. For example, as mentioned above, sheet steel coils are typically formed on two different size mandrels and typically have two different size openings (i.e., 20 inch and 24 inch openings). The known coil protectors do not account for these different size openings and, therefore, sheet steel coil manufacturers must maintain two different size coil protectors in inventory. This creates extra storage and inventory tracking requirements. Additionally, when the coils are made on each mandrel, manufacturing tolerance variations tend to cause the central openings to be of slightly different sizes. For example, coils made on a 20 inch mandrel may have a 20.1 inch diameter central opening or a 20.5 inch diameter central opening. These different size openings tend to cause the known coil protectors to not snugly fit in certain coils with slightly larger size central openings due to variations in manufacturing tolerances. Likewise, when the known coil protectors are made, manufacturing tolerance variations can cause variations in the circumferences or diameters of these known coil protectors, which can lead them to not fit the coils as desired.

Accordingly, there is a need for new coil protectors that solve these problems.

SUMMARY

Various embodiments of the present disclosure solve the above problems by providing a reusable adjustable coil protector configured to be used on a plurality of differently sized coils, and specifically coils with different size central openings. The adjustable coil protector of various embodiments has an unassembled generally linear resting position or configuration and plurality of different assembled generally cylindrical configurations. The adjustable coil protector is formed to normally be in the generally linear unassembled configuration and maintained in the generally linear unassembled configuration for storage and transport before and after use. The adjustable coil protector is bent and wrapped around itself, positioned, and securely locked in a selected one of the plurality of different assembled generally cylindrical configurations prior to mounting the adjustable coil protector on a coil. The selected assembled position or configuration is based on the size of the cylindrical central opening of that coil on which the adjustable coil protector will be used or mounted. The adjustable coil protector is maintained in that selected securely locked assembled generally cylindrical configuration during use on that coil. The adjustable coil protector is configured to be unlocked and disassembled from that selected assembled generally cylindrical configuration after use on that coil for subsequent storage and transport prior to subsequent use on another coil. The adjustable coil protector of the present disclosure is configured to be used with coils made from various different materials, such as paper coils and metal coils (such as sheet steel coils).

In various embodiments, the adjustable coil protector of the present disclosure includes: (a) a side wall engager configured to engage or mate with a side wall of a coil; and (b) a coil inner wall engager connected to the side wall engager and configured to engage or mate with an inner cylindrical wall of the coil that defines the central opening of the coil. The coil inner wall engager includes: (i) a plurality of locking tabs extending from a first end of the body of the coil inner wall engager; (ii) a first array of locking tab engagers positioned adjacent to a second end of the body of the inner wall engager; and (iii) a second array of locking tab engagers spaced from the first array of locking tab engagers. The locking tab engagers are configured to receive and interlock with the plurality of locking tabs such that the coil inner wall engager can be assembled in any one of a plurality of different locked cylindrical positions with different inner wall diameters or circumferences.

In other various embodiments, the adjustable coil protector of the present disclosure includes: (a) a side wall engager configured to engage or mate with a side wall of a coil; and (b) a coil outer wall engager connected to the side wall engager and configured to engage or mate with an outer cylindrical wall of the coil. The coil inner wall engager includes: (i) a plurality of locking tabs extending from a first end of the body of the coil outer wall engager; (ii) a first array of locking tab engagers positioned adjacent to a second end of the body of the outer wall engager; and (iii) a second array of locking tab engagers spaced from the first array of locking tab engagers. The locking tab engagers are configured to receive and interlock with the plurality of locking tabs such that the coil outer wall engager can be assembled in any one of a plurality of different locked cylindrical positions with different outer wall diameters or circumferences.

The present disclosure solves the above problems by providing a reusable adjustable coil protector that: (1) when disassembled, is not relatively large or bulky; (2) when disassembled, can be easily stacked for storage and transport and takes up relatively little space; (3) reduces the need for storage space in coil protector manufacturing facilities, in the coil manufacturing facilities, and in coil use facilities; (4) reduces the need for transport space in coil protector transport vehicles; (5) increases the likelihood of reuse of the coil protector; (6) is recyclable; (7) reduces the likelihood that the coil protector will be placed in the garbage and, even if it is placed in the garbage, minimizes the space it takes up in landfills; (8) can be assembled to have any one of a plurality of different circumferences and diameters; (9) can be used on a plurality of differently sized coils; (10) can be used on coils of the same size with different sized central openings; (11) accounts for intended variations that occur in the size of the central openings of the coils; (12) accounts for unintended variations that occur in the size of the central openings of the coils due to manufacturing tolerance variations; (13) accounts for unintended variations that occur in the coil protector itself due to manufacturing tolerance variations; (14) eliminates the need for different size coil protectors, which also reduces the need for extra storage and inventory tracking; and (15) reduces the overall cost of the manufacturing, storage, warehousing, transport, and reuse of the coil protectors.

Additional features and advantages of the present disclosure are described in, and will be apparent from, the following Detailed Description and the Figures.

DETAILED DESCRIPTION

Figure 6:
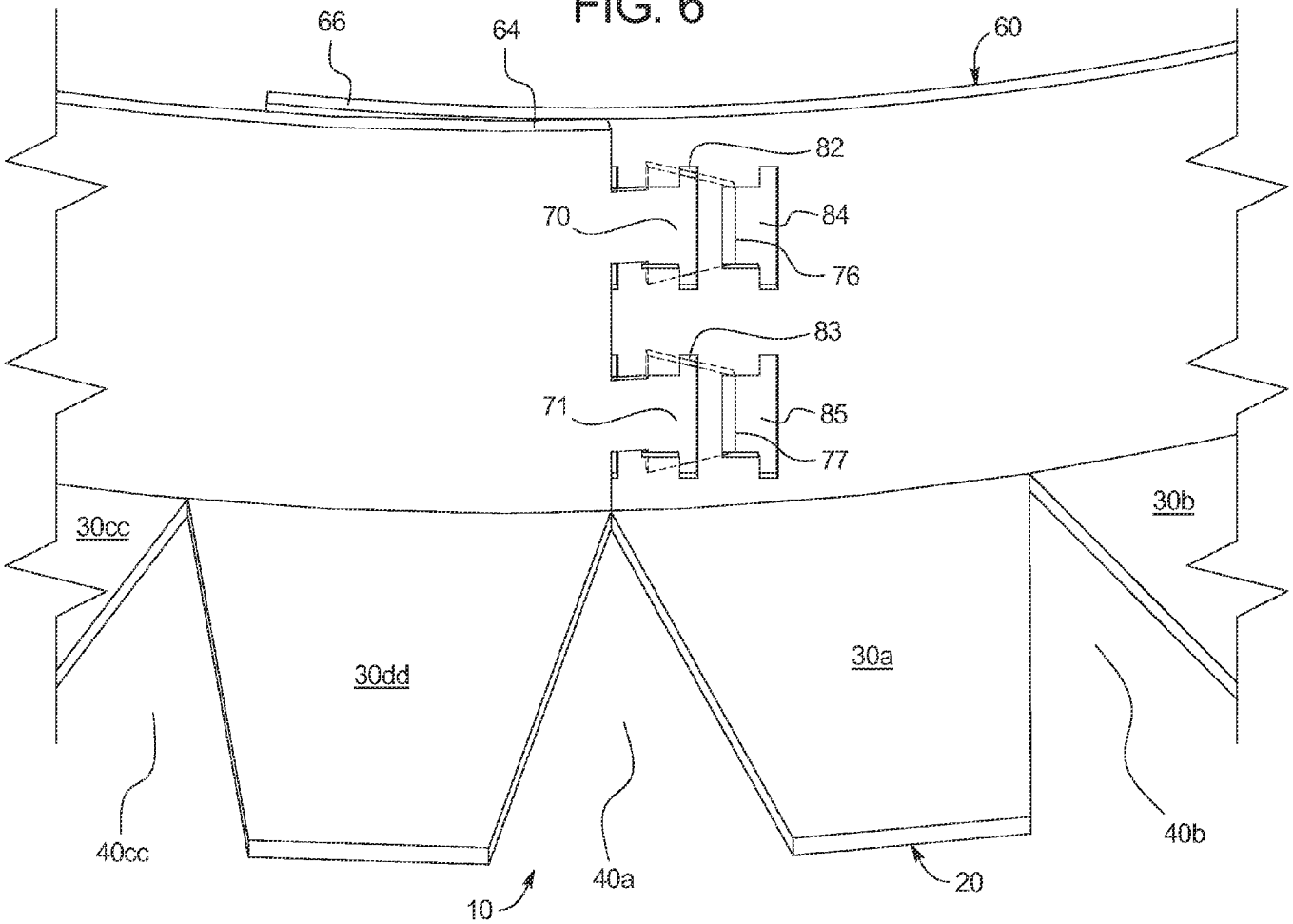
FIG. 6 is an enlarged fragmentary top perspective view of the end sections of the adjustable coil protector of FIG. 1 shown in one of a plurality of assembled positions.
Figure 7:
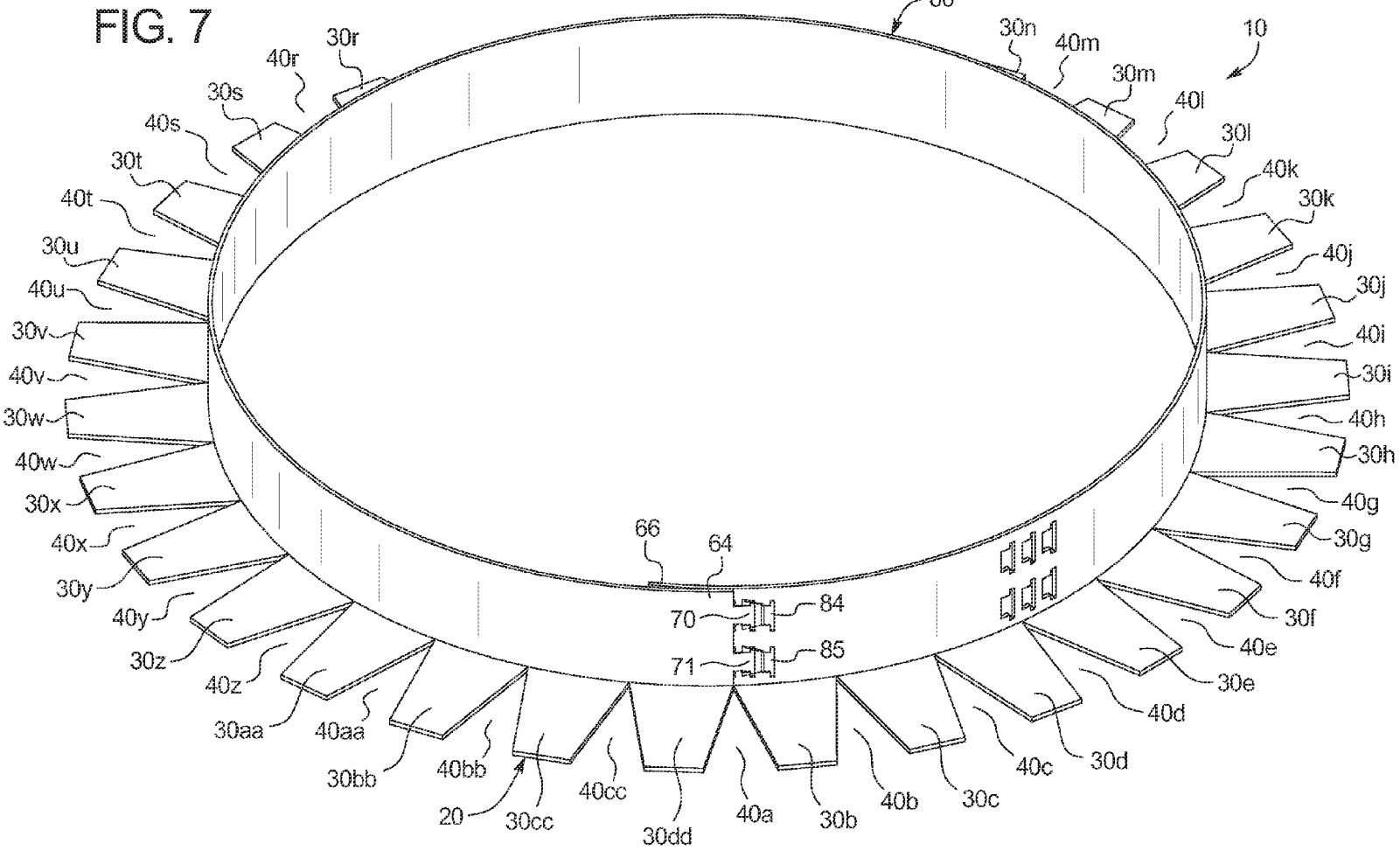
FIG. 7 is a top perspective view of the adjustable coil protector of FIG. 1 shown in one of the plurality of assembled positions.
Figure 8:
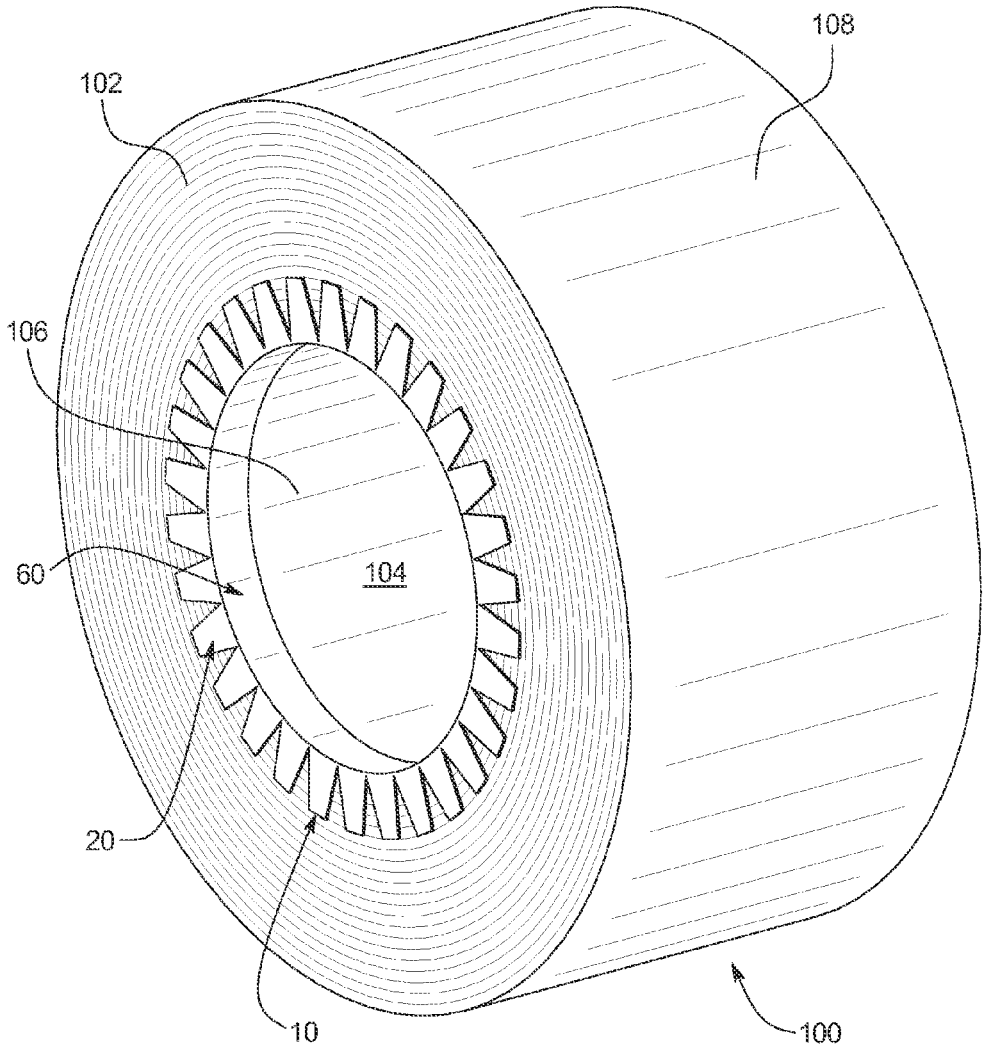
FIG. 8 is a side perspective view of the adjustable coil protector of FIG. 1 shown in one of the assembled positions and mounted on a coil.

Referring now to the drawings, FIGS. 1, 2, 3, 4, 5, 6, 7, and 8 illustrate one example embodiment of the reusable adjustable coil protector of the present disclosure, which is generally indicated by numeral 10. In this example embodiment, the adjustable coil protector 10 includes: (a) a coil side wall engager 20 configured to engage or mate with a side wall of a coil such as the side wall 102 of coil 100 as generally shown in FIG. 8; and (b) an coil inner wall engager 60 integrally connected to the coil side wall engager 20 and configured to engage or mate with an inner circumferential wall that defines the central opening of a coil such as the inner circumferential wall 106 that defines the central opening 104 of coil 100 as also generally shown in FIG. 8.

Figure 1:
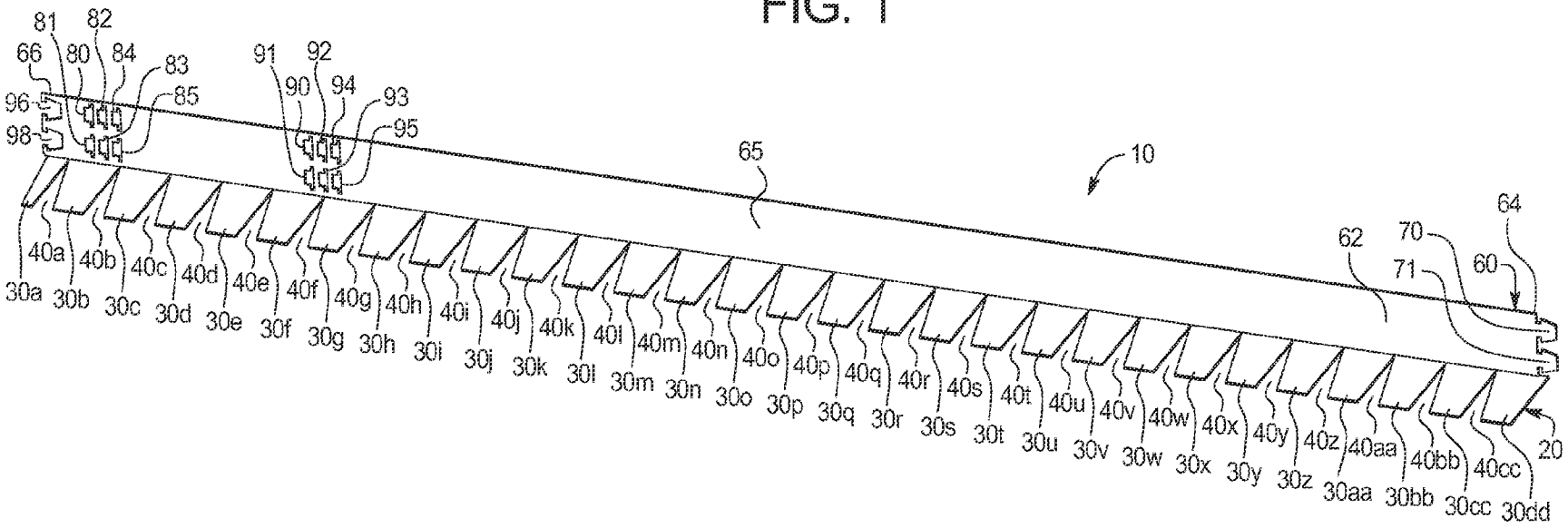
FIG. 1 is a top perspective view of one embodiment of an adjustable coil protector of the present disclosure shown in the unassembled position.
Figure 2:
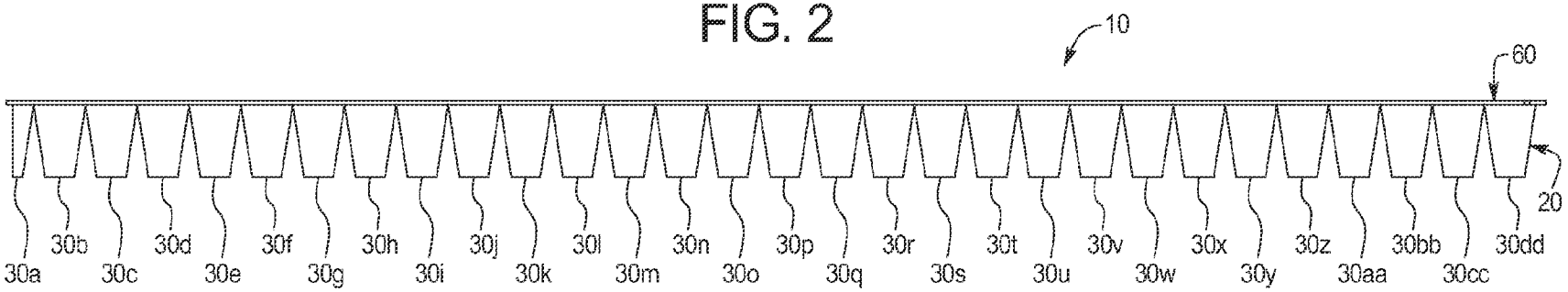
FIG. 2 is a top plan view of the adjustable coil protector of FIG. 1 shown in the unassembled position.
Figure 3:
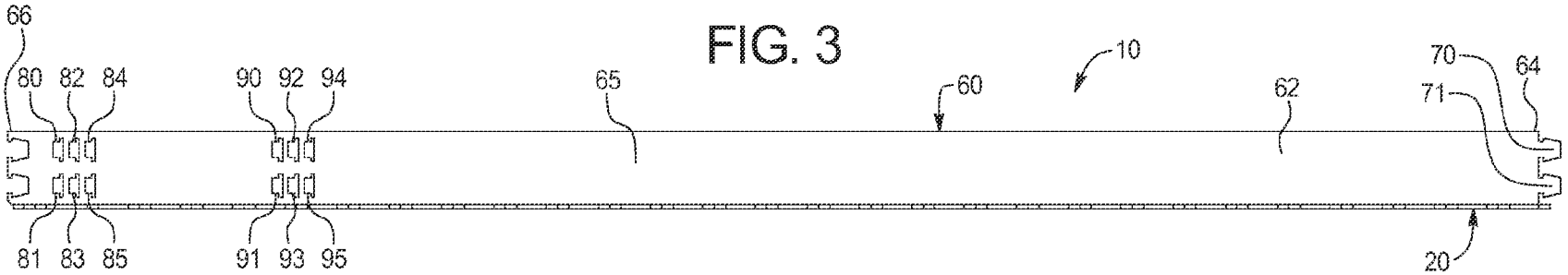
FIG. 3 is a front elevational view of the adjustable coil protector of FIG. 1 shown in the unassembled position.
Figure 4:
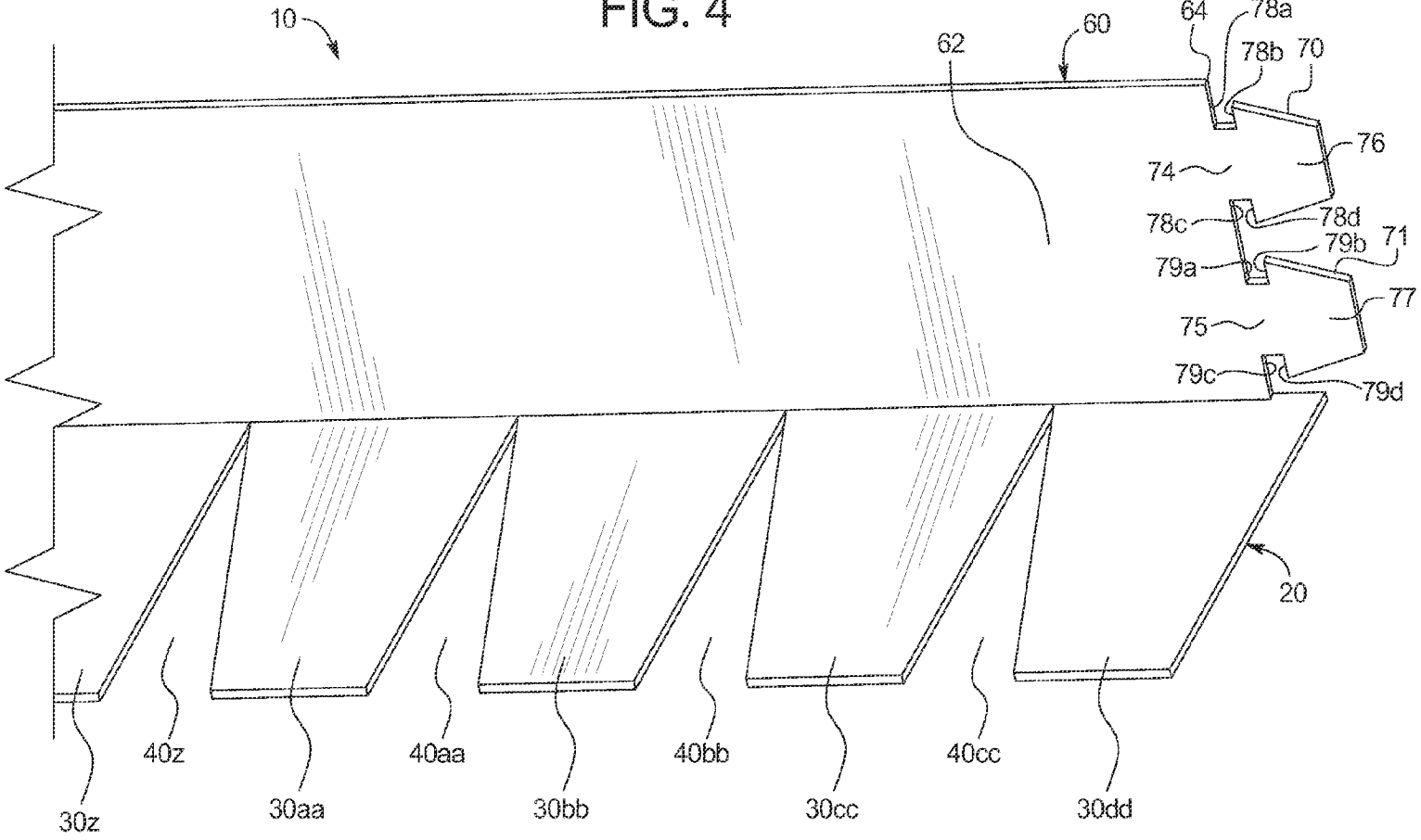
FIG. 4 is an enlarged fragmentary top perspective view of one end section of the adjustable coil protector of FIG. 1 shown in the unassembled position.
Figure 5:
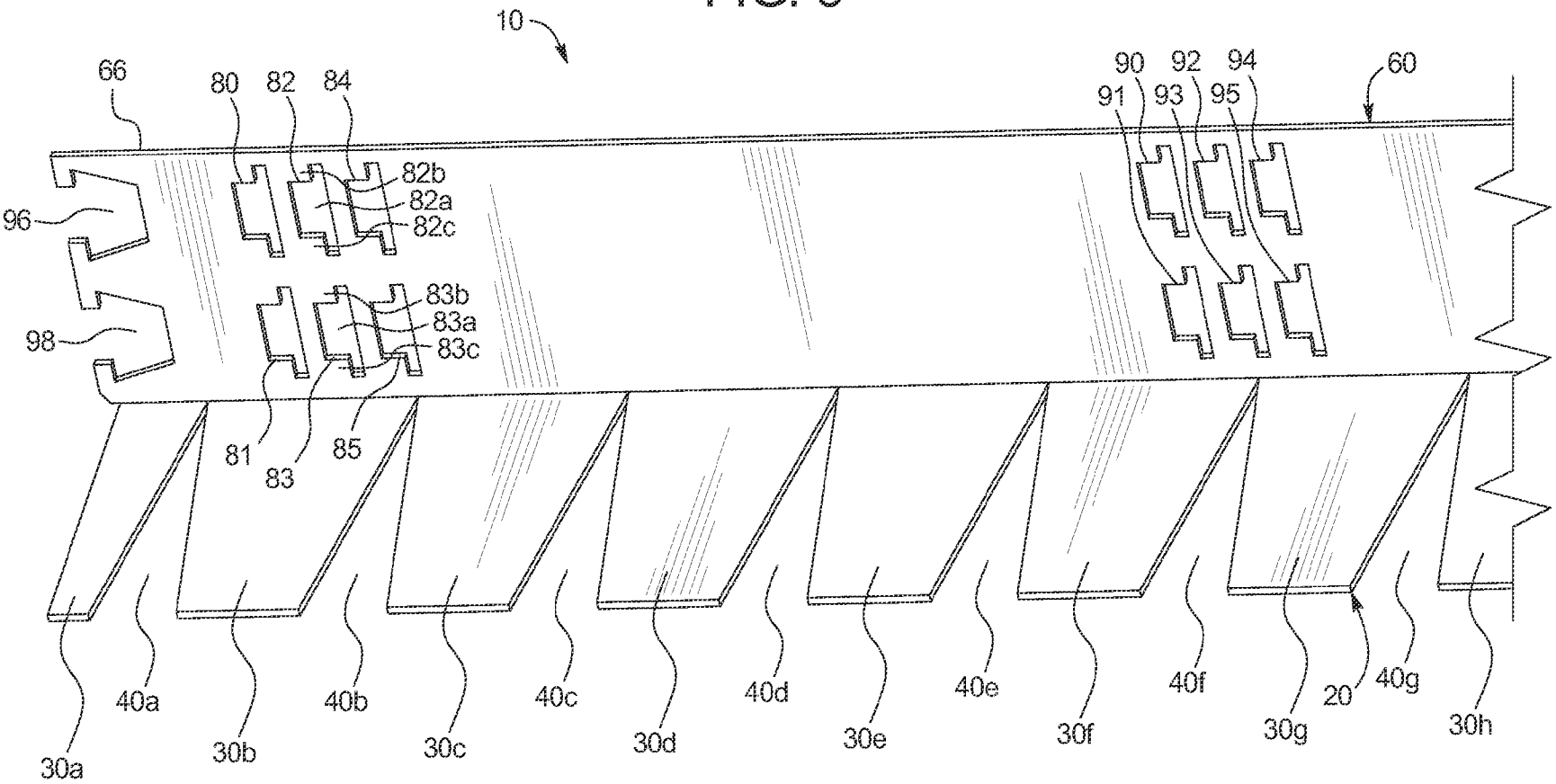
FIG. 5 is an enlarged fragmentary top perspective view of another end section of the adjustable coil protector of FIG. 1 shown in the unassembled position.

The adjustable coil protector 10 has an unassembled generally linear resting position or configuration (as shown in FIGS. 1, 2, 3, 4, and 5) and plurality of different assembled generally cylindrical configurations (one of which is shown in FIGS. 6, 7, and 8). The adjustable coil protector 10 is formed to normally be in the generally linear unassembled configuration (as further described below) and maintained in the generally linear unassembled configuration for storage and transport before and after use. The adjustable coil protector 10 is bent and wrapped around itself, positioned, and securely locked in a user selected one of the plurality of different assembled generally cylindrical configurations prior to mounting the adjustable coil protector on a coil (such as coil 100 shown in FIG. 8). The selected assembled position or configuration is based on the size of the cylindrical central opening of that coil on which the adjustable coil protector will be used or mounted. The adjustable coil protector 10 is maintained in that selected securely locked assembled generally cylindrical configuration during use on that coil. The adjustable coil protector 10 is configured to be unlocked and disassembled from that selected assembled generally cylindrical configuration after use on that coil for subsequent storage and transport prior to subsequent use on another coil.

More specifically, the coil side wall engager 20 of this illustrated embodiment of the adjustable coil protector 10 of the present disclosure includes a plurality of spaced apart coil side wall engaging segments or arms 30*a*, 30*b*, 30*c*, 30*d*, 30*e*, 30*f*, 30*g*, 30*h*, 30*i*, 30*j*, 30*k*, 30*l*, 30*m*, 30*n*, 30*o*, 30*p*, 30*q*, 30*r*, 30*s*, 30*t*, 30*u*, 30*v*, 30*w*, 30*x*, 30*y*, 30*z*, 30*aa*, 30*bb*, 30*cc*, and 30*dd* that respectively define a plurality of spaced apart slots or notches 40*a*, 40*b*, 40*c*, 40*d*, 40*e*, 40*f*, 40*g*, 40*h*, 40*i*, 40*j*, 40*k*, 40*l*, 40*m*, 40*n*, 40*o*, 40*p*, 40*q*, 40*r*, 40*s*, 40*t*, 40*u*, 40*v*, 40*w*, 40*x*, 40*y*, 40*z*, 40*aa*, 40*bb*, and 40*cc*. In this embodiment, the coil side wall engaging segment or arm 30*a* has a relatively narrow trapezoid shape, and each of the coil side wall engaging segments or arms 30*b* to 30*dd* has a relatively wide trapezoid shape. In this embodiment, each of the spaced apart slots or notches 40*a* to 40*cc* is generally "V" shaped, with the vertex of the "V" positioned adjacent to the coil inner wall engager 60.

In the generally linear unassembled configuration of the adjustable coil protector 10, the side wall engager 20 generally extends at an approximately 90 degree angle from coil inner wall engager 60, and each of the coil side wall engaging segments or arms 30*a* to 30*dd* respectively extends at an approximately 90 degree angle from coil inner wall engager 60. In each of the generally cylindrical assembled configurations of the coil protector 10, the approximately 90 degree relationship between the coil side wall engager and the coil inner wall engager 60 is maintained at each point along the circumference of coil inner wall engager 60, and specifically each of the coil side wall engaging segments or arms 30*a* to 30*dd* maintains an approximately 90 degree angle from the coil inner wall engager 60.

When in the generally linear unassembled configuration, the slots or notches 40*a* to 40*cc* respectively provide clearance between adjacent coil side wall engaging segments or arms 30*a* to 30*dd*. The slots or notches 40*a* to 40*cc* are also configured to facilitate the articulation of the coil inner wall engager 60 from the generally linear unassembled configuration to each of the different generally cylindrical assembled configurations. To enable a user to adjustably configure the adjustable coil protector 10 from the generally linear unassembled configuration to one of the generally cylindrical assembled configurations, the side wall engaging segments or arms 30*a* to 30*dd* are evenly or approximately evenly spaced with respect to one another and alternately with respect to the spaced apart slots or notches 40*a* to 40*cc* along the entire side wall engager 20.

It should be appreciated that the shapes and sizes of the overall side wall engager may vary in accordance with the present disclosure. It should also be appreciated that the quantity, shapes, and sizes of each of the coil side wall engaging segments or arms may vary in accordance with the present disclosure. It should further be appreciated that the quantity, shapes, and sizes of the slots or notches may also vary in accordance with the present disclosure. It should additionally be appreciated that the angle of the overall side wall engager with respect to the coil inner wall engager may vary, and that the angle of one or more of the side wall engaging segments or arms relative to the coil inner wall engager may vary in accordance with the present disclosure.

The coil inner wall engager 60 in this illustrated embodiment of the present disclosure includes: (i) an elongated body 62 having a first end section 64, a second end section 66, and a central section 63 extending between the first end section 64 and the second end section 66; (ii) a plurality of aligned locking tabs 70 and 71 extending from the first end section 64 of the body 62; (iii) a first array or plurality of aligned locking tab engagers 80, 81, 82, 83, 84, and 85 defined in or by the second end section 66 of the body 62; and (iv) a second array or plurality of aligned locking tab engagers 90, 91, 92, 93, 94, and 95 defined in or by the second end section 66 of the elongated body 62 more toward the central section 63. Locking tab 70 is configured to selectively engage and be secured into or by each of the locking tab engagers 80, 82, 84, 90, 92, and 94, and locking tab 71 is configured to selectively engage and be secured into or by each of the locking tab engagers 81, 83, 85, 91, 93, and 95 to enable a user to removably secure the first end section 64 of body 62 to the second end section 66 of the body 62 (and thus the first end section 64 of the adjustable coil protector 10 to the second end section 66 of adjustable coil protector 10).

In this illustrated embodiment, each of the locking tabs 70 and 71 are identical, although it should be appreciated that the locking tabs do not need to be identical in accordance with the present disclosure. More specifically, locking tab 70 includes: (a) a neck 74 connected to and extending from the body 62; (b) a head 76 connected to the neck 74; and (c) shoulders 78*a*, 78*b*, 78*c*, and 78*d* positioned on both sides of neck 74. Likewise, locking tab 71 includes: (a) a neck 75 connected to and extending from the body 62; (b) a head 77 connected to the neck 75; and (c) shoulders 79*a*, 79*b*, 79*c*, and 79*d* positioned on both sides of neck 75. These locking tabs 70 and 71 are configured to be insertably and removably securely interlocked with the different sets of tab engagers 80 and 81, 82 and 83, 84 and 85, 90 and 91, 92 and 93, or 94 and 95 as generally shown in FIGS. 6 and 7 and as further discussed below.

In this embodiment, each of the locking tab engagers 80, 81, 82, 83, 84, 85, 90, 91, 92, 93, 94, and 95 are identical, although it should be appreciated that the locking tab engagers do not need to be identical in accordance with the present disclosure. As best shown in FIG. 5, each of locking tab engagers 80, 82, 84, 90, 92, and 94 includes one or more edges or walls defining a "T" shaped opening positioned, sized, and shaped to receive locking tab 70, and two locking shoulders positioned, sized, and shaped to securely engage and securely lock the head 76 of locking tab 70. As also best shown in FIG. 5, each of locking tab engagers 81, 83, 85, 91, 93, and 95 includes one or more edges or walls defining a "T" shaped opening positioned, sized, and shaped to receive locking tab 71, and two locking shoulders positioned, sized, and shaped to securely engage and securely lock the head 77 of locking tab 71. For example, as best shown in FIGS. 5 and 6: (1) locking tab engager 82 includes opening 82*a* configured such that the head 76 of locking tab 70 can be inserted through the opening 82*a* and then pulled backwards to engage shoulders 82*b* and 82*c*; and (2) locking tab engager 83 includes opening 83*a* configured such that the head 77 of locking tab 71 can be inserted through the opening 83*a* and then pulled backwards to engage shoulders 83*b* and 83*c*. It should be appreciated that the quantity, shapes, locations, and sizes of the locking tab engagers may vary in accordance with the present disclosure.

In this illustrated embodiment, the adjustable coil protector 10 includes a pair or two locking tabs 70 and 71 that when simultaneously engaged by one of the sets of locking tab engagers (i.e., 80 and 81, 82 and 83, 84 and 85, 90 and 91, 92 and 93, or 94 and 95) minimize the potential for rolling or other movement of the adjustable coil protector 10 when mounted in the central opening 104 on the coil 100 that may occur when inserting a hook or chain through the central opening 104 of the coil 100 to lift the coil 100 or to hold down the coil 100. It should be appreciated that in other embodiments, the adjustable coil protector of the present disclosure includes only one locking tab configured to selectively engage one of a plurality of appropriately configured and positioned locking tab engagers. It should further be appreciated that, in other embodiments, the adjustable coil protector of the present disclosure includes only one locking tab configured to engage an appropriately configured and positioned locking tab engager. It should further be appreciated that, in other embodiments, the adjustable coil protector of the present disclosure includes more than two locking tabs configured to engage with appropriately configured and positioned locking tab engagers. It should be appreciated as indicated above that the quantity, shapes, and sizes of the locking tabs may vary in accordance with the present disclosure.

In this illustrated embodiment, the locking tab engagers 80, 81, 82, 83, 84, and 85 are arranged in a first array and the locking tab engagers 90, 91, 92, 93, 94, and 95 are arranged in a second array spaced apart from the first array. Each array has first and second rows and first, second, and third columns in this illustrated embodiment. The first array is positioned in the body 62 of the coil inner wall engager 60 adjacent to the second end 66 to adjustably accommodate a coil having a first size central opening (such as a sheet metal coil having an approximately 24 inch inner diameter central opening). The second array is positioned in the body 62 of the coil inner wall engager 60 somewhat spaced from the second end 66 to adjustably accommodate a coil having a second different size central opening (such as a sheet metal coil having an approximately 20 inch inner diameter central opening). It should be appreciated that the present disclosure contemplates the coil inner wall engager alternatively having only one array, having more than two arrays, differently positioned or spaced apart arrays, and different quantities of locking tab engagers in the arrays.

In this illustrated embodiment: (1) locking tab engagers 80, 82, and 84 in the first row of the first array are positioned approximately equidistant to one another; (2) locking tab engagers 81, 83, and 85 in the second row of the first array are positioned approximately equidistant to one another; (3) locking tab engagers 90, 92, and 94 in the first row of the second array are positioned approximately equidistant to one another; (4) locking tab engagers 91, 93, and 95 in the second row of the second array are positioned approximately equidistant to one another; (5) locking tab engagers 80, 82, and 84 in the first row of the first array are aligned approximately vertically with locking tab engagers 81, 83, and 85 in the second row of the first array; and (6) locking tab engagers 90, 92, and 94 in the first row of the second array are aligned approximately vertically with locking tab engagers 91, 93, and 95 in the second row of the second array. It should be appreciated that the locking tab engagers can be alternatively arranged in accordance with the present disclosure such as: (a) in staggered positions; (b) with different lateral spacing; and/or (c) with different vertical spacing.

The relatively large or substantial space between the first array and the second array is configured to account for substantial differences in the sizes of the central opening of different coils (such as the 20 inch and the 24 inch inner diameter openings explained above). The relatively small or minor spaces between the first, second, and third columns of locking tab engagers in each of the first array and the second array are configured to account for small or minor difference in the sizes of the central openings of the coils, variations due to manufacturing tolerances, and variations in central opening size due to protective coverings such as shrink wrap on the coils. These relatively small or minor spaces between the first, second, and third columns of locking tab engagers of each array provide incremental adjustments of the outer diameter or circumference of the coil inner wall engager 60 to account for these relatively small or minor differences, whether the coil protector 10 is used for a first size central opening (such as a 24 inch inner diameter central opening) or a second different size central opening (such as a 20 inch inner diameter central opening). It should further be appreciated that, in alternative embodiments, the adjustable coil protector of the present disclosure is sized to accommodate smaller or larger coil inner diameters or circumferences or different combinations of coil inner diameters or circumferences. In such embodiments, the arrays of locking tab engagers are appropriately positioned along the coil inner wall engager to accommodate smaller or larger coil inner diameters or circumferences.

To install the adjustable coil protector 10 on a coil such as coil 100, a user bends or wraps the body 62 of the coil inner wall engager about itself and inserts the locking tabs 70 and 71 into slots of the desired set of locking tab engagers (i.e., 80 and 81, 82 and 83, 84 and 85, 90 and 91, 92 and 93, or 94 and 95) and interlocks the shoulders of the locking tabs 70 and 71 with the locking tab engagers as shown in FIG. 6 to form the ring shown in FIG. 7. The adjustable coil protector 10 can then be mounted to the coil 100 by inserting the coil inner wall engager 60 of the assembled adjustable coil protector 10 into the central opening 104 of the coil 100 until the coil side wall engager 20 mates with the side wall 102 of the coil 10. The process is duplicated on the other side of the coil 100 with another adjustable coil protector 10. Once inserted, each adjustable coil protector 10 provides a stable and reliable form of protection for the side wall 102 and the inner wall 106 of the coil 100. When the adjustable coil protector is no longer needed on the coil, it is removed from the coil and disassembled or reconfigured into the original linear "L" shaped structure for storage and transport until needed again for another coil.

It should thus be appreciated from the above that the adjustable coil protector of various embodiments of the present disclosure is: (a) reusable; (b) configured to be quickly and easily assembled and disassembled; (c) configured to securely locked in each of the assembled positions; and (d) adjustable in two different ways or manners (i.e., in addition to accommodating different size diameters, the adjustable coil protector accommodates tolerance-based variations in the internal diameters of the coils themselves, as well as practical or unavoidable variations experienced in the dimensions of the coil protector itself).

It should additionally be appreciated that different locking or securing mechanisms may be employed in the adjustable coil protector in accordance with the present disclosure.

In various embodiments, the adjustable coil protector of the present disclosure is made from a suitable plastic such as a flexible polymer such as polyethylene. In other embodiments, the adjustable coil protector is made from one or more other suitable materials that provide for an unassembled compact storage configuration as described herein while also facilitating assembly or reconfiguration of the adjustable coil protector into a ring for installation on a coil.

In various embodiments, the adjustable coil protector of the present disclosure is manufactured using an extrusion process and a severing process (including a cutting process and a stamping process). More specifically, in one embodiment, an extrusion process is used to form a linear "L" shaped billet from which multiple adjustable coil protectors are subsequently formed. After the extrusion process, the billet is cut and stamped to form the individual adjustable coil protectors. The stamping tool is configured to form the shape of locking tabs 70 and 71, the locking tab engagers 80, 81, 82, 83, 84, 85, 90, 91, 92, 93, 94, and 95, the side wall engaging segments or arms 30*a* to 30*dd*, and the slots or notches 40*a* to 40*cc* between the side wall engaging segments or arms 30*a* to 30*dd*. In the illustrated embodiment, the stamping tool also creates the voids 96 and 98 in the second end section 66 of the body 62 of the coil inner wall engager 60 corresponding to locking tabs 70 and 71 from an adjacent adjustable coil protector formed from the billet. This stamping process that creates these voids 96 and 98 eliminates material waste and does no harm to the utility of adjustable coil protector of the present disclosure. It should be appreciated that the order of the stamping processes and cutting processes may vary, and that in one preferred embodiment: (1) the billet is formed; (2) then the slots or notches 40*a* to 40*cc* between the side wall engaging segments or arms 30*a* to 30*dd* are stamped; and (3) then the locking tabs 70 and 71, the locking tab engagers 80, 81, 82, 83, 84, 85, 90, 91, 92, 93, 94, and 95, and the voids 96 and 98 are all simultaneously formed in one combined cutting and stamping process. It should also be appreciated that the stamped out parts can be recycled. Thus, the as-manufactured linear "L" shaped structure enables the adjustable coil protector of the present disclosure to be manufactured using an extrusion process permitting long billets to be cut into unit lengths to minimize material waste. It should further be appreciated that the adjustable coil protector of the present disclosure can be made in other manners in accordance with the present disclosure.

It should be appreciated that the adjustable coil protector of the present disclosure may be used in connection with other coils besides the sheet metal coils discussed here, such as rolls of paper and the like.

It should be appreciated that, in other various embodiments of the present disclosure, the adjustable coil protector is configured to protect the outer circumferential wall of a coil. In these alternative example embodiments, which are not shown, the adjustable coil protector includes: (a) a coil side wall engager configured to engage or mate with a side wall of a coil, such as the side wall 102 of coil 100; and (b) an coil outer wall engager integrally connected to the coil side wall engager and configured to engage or mate with an outer circumferential wall of a coil, such as the outer circumferential wall 108 of coil 100.

It should also be appreciated from the above that the adjustable coil protector of the present disclosure provides for efficient manufacture, transport, and warehousing by minimizing the as-manufactured volume of each adjustable coil protector to a linear "L" shaped unassembled structure that is easy to stack upon one another for storage and that requires minimal storage volume. It should also be appreciated that a pallet of adjustable coil protectors of the present disclosure can replace a semi trailer volume of the known coil protectors described above. It should thus be appreciated from the above that the adjustable coil protector of the present disclosure is configured to: (a) eliminate the need for making and maintaining an inventory for different size coil protectors; (b) substantially reduce inventory tracking and warehousing requirements; and (c) increase the likelihood of reuse of the adjustable coil protectors of the present disclosure.

It should be understood that modifications and variations may be effected without departing from the scope of the novel concepts of the present disclosure, and it should be understood that this application is to be limited only by the scope of the appended claims.

The invention is claimed as follows:

1. An adjustable coil protector comprising:

a coil side wall engager configured to mate with a side wall of a coil, said coil side wall engager including a plurality of spaced apart coil side wall engaging arms that define a plurality of spaced apart notches; and a coil inner wall engager connected to the coil side wall engager and configured to mate with an inner wall of the coil that defines a central opening of the coil, the coil inner wall engager including:

(a) an elongated body having a first end section, a second end section, and an intermediate section between the first end section and the second end section, said second end section of the body including a plurality of surfaces extending inwardly from an outer edge of a perimeter of the second end section toward the intermediate section, the plurality of surfaces partially defining a plurality of voids in the second end section;

(b) a plurality of locking tabs extending from an outer edge of a perimeter of the first end section of the body, wherein the locking tabs each have a shape corresponding to a shape of one of the plurality of voids; and (c) a plurality of locking tab engagers defined by said second end section of the body, each said locking tab engager configured to receive and interlock with one of the locking tabs, wherein said coil inner wall engager is bendable from an unassembled position in which the locking tabs are not interlocked with the locking tab engagers to one of a plurality of different assembled positions in which the locking tabs interlock with a plurality of the locking tab engagers.

2. The adjustable coil protector of claim 1, wherein the coil side wall engager extends at an approximately 90 degree angle from the coil inner wall engager.

3. The adjustable coil protector of claim 1, wherein a plurality of the spaced apart notches are each "V" shaped.

4. The adjustable coil protector of claim 1, wherein a plurality of the spaced apart coil side wall engaging arms each have a trapezoid shape.

5. The adjustable coil protector of claim 1, wherein each of the locking tabs includes:

(a) a neck connected to and extending from the outer edge of the perimeter of the first end section of the body, (b) a head connected to the neck, and (c) a plurality of shoulders.

6. The adjustable coil protector of claim 1, wherein each of the locking tab engagers defines a "T" shaped opening.

7. The adjustable coil protector of claim 1, which includes two locking tabs and at least four locking tab engagers.

8. The adjustable coil protector of claim 1, wherein locking tab engagers are part of a first array of locking tab engagers and the body defines a second array of a plurality of locking tab engagers, said second array spaced apart from the first array, each said locking tab engager configured to receive and interlock with one of the locking tabs, wherein said coil inner wall engager is bendable from the unassembled position in which the locking tabs are not interlocked with the locking tab engagers to one of a plurality of different first assembled positions in which the locking tabs are interlocked with a plurality of the first array of locking tab engagers and to one of a plurality of different second assembled positions in which the locking tabs are interlocked with a plurality of the second array of locking tab engagers.

9. A protected coil comprising:

a coil of material defining a central opening;

the adjustable coil protector of claim 1, positioned in the central opening, such that: (i) the coil side wall engages with a side wall of the coil, so that the coil side wall engager extends radially across the side wall of the coil; and (ii) the coil inner wall engages an inner wall of the coil that defines the central opening of the coil.

10. An adjustable coil protector comprising:

a coil side wall engager configured to mate with a side wall of a coil, said coil side wall engager including a plurality of spaced apart coil side wall engaging arms that define a plurality of spaced apart notches; and a coil inner wall engager connected to the coil side wall engager and configured to mate with an inner wall of the coil that defines a central opening of the coil, the coil inner wall engager including:

(a) an elongated body having a first end section, a second end section, and an intermediate section between the first end section and the second end section, (b) a plurality of locking tabs extending from the first end section of the body, (c) a first array of a plurality of locking tab engagers defined by said second end section of the body, each said locking tab engager configured to receive and interlock with one of the locking tabs, (d) a second array of a plurality of locking tab engagers defined by said second end section of the body, each said locking tab engager configured to receive and interlock with one of the locking tabs, said second array spaced from the first array more toward the intermediate section, (e) wherein the second end section of the body includes a plurality of surfaces extending inwardly from an outer edge of a perimeter of the second end section of the body toward the intermediate section, the plurality of surfaces partially defining a plurality of voids in the second end section, and (f) wherein the plurality of locking tabs extend from an outer edge of a perimeter of the first end section of the body, wherein the locking tabs each have a shape corresponding to a shape of one of the plurality of voids, wherein said coil inner wall engager is bendable from an unassembled position in which the locking tabs are not interlocked with the locking tab engagers to: (i) one of a first plurality of different assembled positions in which the locking tabs are interlocked with a plurality of the locking tab engagers of the first array, and (ii) one of a second plurality of different assembled positions in which the locking tabs are interlocked with a plurality of locking tab engagers of the second array.

11. The adjustable coil protector of claim 10, wherein the coil side wall engager extends at an approximately 90 degree angle from the coil inner wall engager.

12. The adjustable coil protector of claim 10, wherein a plurality of the spaced apart notches are each "V" shaped.

13. The adjustable coil protector of claim 10, wherein a plurality of the spaced apart coil side wall engaging arms each have a trapezoid shape.

14. The adjustable coil protector of claim 10, wherein each of the locking tabs includes:

(a) a neck connected to and extending from the first end section of the body of the coil inner wall engager;

(b) a head connected to the neck; and (c) a plurality of shoulders.

15. The adjustable coil protector of claim 14, wherein each of the locking tab engagers defines a "T" shaped opening.

16. The adjustable coil protector of claim 10, which includes two locking tabs and at least four locking tab engagers in the first array and at least four locking tab engagers in the second array.

17. The adjustable coil protector of claim 10, which includes two locking tabs, six locking tab engagers in the first array, and six locking tab engagers in the second array.

18. A protected coil comprising:

a coil of material defining a central opening;

the adjustable coil protector of claim 10, positioned in the central opening, such that: (i) the coil side wall engages with a side wall of the coil, so that the coil side wall engager extends radially across the side wall of the coil; and (ii) the coil inner wall engages an inner wall of the coil that defines the central opening of the coil.

* * * * *